US007997458B2

(12) United States Patent
Wickham

(10) Patent No.: US 7,997,458 B2
(45) Date of Patent: Aug. 16, 2011

(54) METERING VALVES FOR DISPENSERS

(75) Inventor: Mark Wickham, Rampton (GB)

(73) Assignee: Consort Medical PLC, Hertfordshire (GB)

( * ) Notice: Subject to any disclaimer, the term of this patent is extended or adjusted under 35 U.S.C. 154(b) by 690 days.

(21) Appl. No.: 10/544,741

(22) PCT Filed: Feb. 6, 2004

(86) PCT No.: PCT/GB2004/000486

§ 371 (c)(1),
(2), (4) Date: Feb. 4, 2008

(87) PCT Pub. No.: WO2004/069689

PCT Pub. Date: Aug. 19, 2004

(65) Prior Publication Data

US 2008/0135584 A1 Jun. 12, 2008

(30) Foreign Application Priority Data

Feb. 7, 2003 (GB) ..... 0302812.3

(51) Int. Cl.
*B65D 83/00* (2006.01)

(52) U.S. Cl. ..... 222/402.2; 222/402.1; 222/402.24; 222/402.25

(58) Field of Classification Search ..... 222/402.2, 222/402.1, 402.24, 402.25, 1
See application file for complete search history.

(56) References Cited

U.S. PATENT DOCUMENTS 2,788,925 A 4/1957 Ward
2,856,103 A 10/1958 Ward
2,932,432 A * 4/1960 Beard, Jr. ..... 222/402.2
2,998,168 A * 8/1961 Waldherr ..... 222/402.2
3,313,459 A * 4/1967 Ryuichi ..... 222/402.2
3,495,567 A 2/1970 Hayes et al.
3,586,216 A * 6/1971 Jordan et al. ..... 222/402.12
3,757,732 A 9/1973 Frey
3,950,939 A 4/1976 Meisner et al.

(Continued)

FOREIGN PATENT DOCUMENTS

DE 19825031 2/1999

(Continued)

OTHER PUBLICATIONS

International Search Report corresponding to International Application No. PCT/GB2004/000486, dated May 24, 2004.

(Continued)

*Primary Examiner* — Kevin P Shaver
*Assistant Examiner* — Donnell Long
(74) *Attorney, Agent, or Firm* — Smith, Gambrell & Russell, LLP

(57) ABSTRACT

A metering valve (1) is provided for a pressurised container (14) containing a pharmaceutical formulation. The valve has a stem (2) with a central flange (11) and a hollow open end (19) with a side port (20). The stem slides in a body (3) having larger and smaller diameter portions, and being closed off by a seal (4) against which the flange (11) rests in an inoperative position. A second seal is located around the stem on the opposite side of the flange and trapped by a spring (6) which urges the stem into its inoperative position. When the stem is depressed, the inner seal (5) forms a sliding seal with the smaller diameter portion of the body to define a metering chamber (13) filled with the pharmaceutical. Continued depression opens the side hole (20) to allow the contents of the metering chamber to be dispensed.

9 Claims, 4 Drawing Sheets

U.S. PATENT DOCUMENTS

| | | | | |
|---|---|---|---|---|
| 4,116,370 | A * | 9/1978 | Spitzer et al. | 222/402.18 |
| 4,362,257 | A | 12/1982 | Shay | |
| 4,811,868 | A | 3/1989 | Nitta | |
| 5,211,317 | A | 5/1993 | Diamond et al. | |
| 5,349,945 | A | 9/1994 | Wass et al. | |
| 5,356,012 | A | 10/1994 | Tang et al. | |
| 5,421,482 | A | 6/1995 | Garby et al. | |
| 5,836,299 | A | 11/1998 | Kwon | |
| 6,006,745 | A * | 12/1999 | Marecki | 128/200.23 |
| 6,006,954 | A | 12/1999 | Warby | |
| 6,047,946 | A * | 4/2000 | Kolanus | 251/89 |
| 6,076,521 | A | 6/2000 | Lindahl et al. | |
| 6,131,777 | A * | 10/2000 | Warby | 222/402.2 |
| 6,170,717 | B1 * | 1/2001 | Di Giovanni et al. | 222/402.2 |
| 6,283,365 | B1 | 9/2001 | Bason | |
| 6,394,321 | B1 * | 5/2002 | Bayer | 222/402.24 |
| 6,454,140 | B1 * | 9/2002 | Jinks | 222/402.2 |
| 6,474,513 | B2 * | 11/2002 | Burt | 222/402.1 |
| 6,615,827 | B2 | 9/2003 | Greenwood et al. | |
| 6,679,251 | B1 | 1/2004 | Gallem et al. | |
| 6,752,153 | B1 | 6/2004 | Eckert | |
| 6,832,704 | B2 * | 12/2004 | Smith | 222/402.1 |
| 6,978,915 | B1 * | 12/2005 | Russell | 222/402.2 |
| 7,107,986 | B2 | 9/2006 | Rand et al. | |
| 7,137,391 | B2 | 11/2006 | Bruna | |
| 7,143,764 | B1 | 12/2006 | Dagsland et al. | |
| 7,156,258 | B2 | 1/2007 | Eckert | |
| 7,195,134 | B2 | 3/2007 | Ouyang | |
| 7,543,582 | B2 | 6/2009 | Lu et al. | |
| 7,575,130 | B2 | 8/2009 | Blacker et al. | |
| 7,650,883 | B2 | 1/2010 | Scarrott et al. | |
| 7,726,555 | B2 | 6/2010 | Minshull et al. | |
| 2002/0190085 | A1 | 12/2002 | Stanford | |
| 2003/0178448 | A1 * | 9/2003 | Warby et al. | 222/402.24 |
| 2003/0230602 | A1 * | 12/2003 | Smith | 222/402.1 |
| 2003/0230603 | A1 | 12/2003 | Smith | |
| 2004/0065326 | A1 | 4/2004 | MacMichael et al. | |
| 2004/0134824 | A1 | 7/2004 | Chan et al. | |
| 2004/0139965 | A1 | 7/2004 | Greenleaf et al. | |
| 2004/0221840 | A1 | 11/2004 | Stockman-Lamb | |
| 2005/0011515 | A1 | 1/2005 | Lee et al. | |
| 2006/0151524 | A1 | 7/2006 | Stradella et al. | |
| 2007/0284383 | A1 | 12/2007 | Wright et al. | |
| 2008/0135575 | A1 | 6/2008 | Ingram et al. | |
| 2008/0265198 | A1 | 10/2008 | Warby | |
| 2009/0139516 | A1 | 6/2009 | Augustyn et al. | |

FOREIGN PATENT DOCUMENTS

| | | | |
|---|---|---|---|
| EP | 0190210 | | 12/1987 |
| EP | 1 375 385 | A2 | 1/2004 |
| FR | 2285815 | | 4/1976 |
| FR | 2 568 975 | | 2/1986 |
| GB | 857 115 | A | 12/1960 |
| GB | 864 694 | | 4/1961 |
| GB | 892166 | | 3/1962 |
| GB | 1 287 126 | | 8/1972 |
| GB | 1 336 379 | | 11/1973 |
| GB | 2 004 526 | A | 4/1979 |
| GB | 2 077 229 | A | 12/1981 |
| GB | 2 086 845 | A | 5/1982 |
| GB | 2124587 | | 2/1984 |
| GB | 2 311 982 | A | 10/1997 |
| WO | WO 94/01347 | | 1/1994 |
| WO | 2004/001664 | | 12/2003 |
| WO | 2004/022143 | | 3/2004 |

OTHER PUBLICATIONS

English translation of First Notification of Office Action issued by the Chinese Patent Office on Jun. 26, 2009 for Application No. 200580034276.0.

English translation of Second Notification of Office Action issued by the Chinese Patent Office on Mar. 19, 2010 for Application No. 200580034276.0.

Chinese language Response entitled "Form for Observations" dated Nov. 11, 2009 for Application No. 200580034276.0 together with English translation of accompanying claims.

Combined Search and Examination Report under Sections 17 and 18(3) issued by the UK IPO for Application No. GB0417908.1 dated Jan. 12, 2005.

The Response to First Examination Report dated Aug. 15, 2006 for Application No. GB 0417908.1.

Examination Report under Section 18(3) issued by the UK IPO for Application No. GB 0417908.1 dated Oct. 4, 2006.

The Response to Second Examination Report dated Oct. 23, 2006 for Application No. GB 0417908.1.

* cited by examiner

METERING VALVES FOR DISPENSERS

This invention relates to valve assemblies for pressurised dispensing containers and in particular to valve assemblies capable of dispensing metered doses of the contents of aerosol containers.

The use of aerosol containers to administer medicament, such as drugs or other therapeutically active compounds, by inhalation therapy is commonplace, particularly for the treatment of respiratory disorders, such as asthma where it is important that the amount of material dispensed is a predetermined, accurate volume each time the valve is actuated.

The aerosol container is charged with a propellant liquid composition containing the medicament dissolved or suspended therein and provided with a valve assembly capable of dispensing metered amounts of the composition. Examples of such valve assemblies are disclosed in British Patent Numbers:

864694
1287126
1336379
2004526
2077229
2086845

Many known metering valve assemblies for pressurised aerosol containers comprise a metering chamber positioned at the outlet of the pressurised container which is filled with a new dose of the pharmaceutical formulation immediately after the previous dose has been dispensed. This feature avoids the need to prime the assembly before use. A hollow elongate valve member is arranged for reciprocal movement through the metering chamber between a closed, non-dispensing position where the metering chamber is filled with the pharmaceutical composition to be dispensed and a dispensing position, in which the metered dose of material is dispensed through the valve member to the outside environment. The valve member is again biased to the closed, non-dispensing position. This arrangement allows the dosage of pharmaceutical composition dispensed from the aerosol container to be accurately reproduced with each operation of the valve.

In such prior art valve assemblies described above the elongate valve member is biased to its closed, non-dispensing position, normally under the influence of a spring. Force must be applied to the valve member to overcome the spring and move the valve member into a dispensing position by the user. This type of valve generally employs capillary retention techniques to retain the pharmaceutical composition in the metering chamber between actuations to ensure a complete dose is subsequently dispensed and delivered to the patent. There are several drawbacks to the performance of this general valve design. A key drawback to the performance of this general type of valve is associated with a reduction in the amount of active ingredient by the valve following a period of non-use when the valve member remains in the closed position.

This period of non-use can be overnight and as such extends to 8-12 hours typically. This characteristic relates particularly to suspension based formulations where the formulation consists of the liquefied propellant (such as CFC or HFA) and a micronised powdered active ingredient. In such cases of active loss a proportion of the drug stored in the metering chamber is deposited on the surfaces of the metering chamber, and other components within the chamber such as the reciprocating member (stem) and elastomeric diaphragm (seal). This loss of active ingredient retained by the metering chamber reduces the amount delivered by the valve to the patient. Characteristically the amount of loss is highest at the beginning of the aerosol unit's life when the chamber surfaces are devoid of the drug. As the aerosol unit is repeatedly actuated and the further amounts of drug enter the chamber the surfaces progressively retain less of the active eventually reaching a point through the unit's operational life where the amount deposited is low and its loss becomes insignificant. The loss of a proportion of the active dose due to deposition can be sufficient to seriously impair the aerosol unit's ability to deliver the prescribed amount of drug per actuation.

Another related problem with traditional designs is settling or separation of suspension formulations after extended periods in the metering chamber leading to in homogeneities in the formulation. This problem has been exacerbated in recent years with a move towards using less excipients, such as surfactants that can help prevent separation. The consequence of this can be inaccurate and erratic drug doses delivered to the patient.

Another problem that can occur with traditional designs is 'loss of prime' within the metering chamber. Over time changes in temperature, vibration, or the migration of components of the pharmaceutical formulation can cause a vapour bubble to form in the metering chamber. This can have the effect of reducing the amount of dose delivered to the patient. It can also be costly if several doses have to be 'wasted' in order to ensure a complete and accurate dose can be dispensed to the patient.

Another problem with traditional designs is known as 'ullage'. Here, residual drug formulation is retained within the container after the last delivered dose has been administered. Inconsistencies in drug dose also tend to occur over the last few deliverable doses.

Valves such as those described in WO 94/01347 and GB 9607314 are intended to provide a solution to the loss of active ingredient during the period between actuations. In the case of both valve designs the metering chamber is not created until the valve moving member (stem) is depressed. During depression of the stem the chamber is formed immediately, followed by filling of the chamber by the pharmaceutical formulation and then followed by discharge of the chamber contents to the outside environment. Allowing the stem to return to the closed position removes the presence of the chamber. As the metering chamber exists for a very short period of time, in the region of 500 milliseconds, the time for drug to be deposited on the surface of the chamber is significantly reduced. Also, as the chamber only forms and fills with drug formulation (taken from the bulk container) on actuation there is no time for inhomogeneities to develop within the formulation before delivery.

The consequence of this will therefore be a more consistent delivered dose.

Both of the above mentioned valves contain two reciprocating seals. The first prevents loss of container contents to the outside environment, the second provides a means for isolating the metering chamber from the container contents. The designs of both the referenced valves involve the chamber isolating seal being stationary and located in position by the body of the valve. Both of these valves would be expected to suffer from performance issues as a result of employing stationary chamber isolating seals in the manner describe by the patents. In the case of both valves the chamber isolation seal is additionally required to perform a secondary function, to allow the free passage of the pharmaceutical composition to pass by the seal when the aerosol container is being filled. Typically the contents are pressure filled through the metering valve by a purpose designed filling machine which injects the pharmaceutical composition into the container under pressure, the propellant/drug passing through the valve when the valve stem is fully depressed. In this position the chamber isolating seal opposes passage of the contents because its primary function is to prevent such movement of the container contents as otherwise the valve fails to provide a metering function. However, as the filling machine imparts high pressure to the propellant drug composition the isolating seal is intended to distort under pressure to a second position allowing passage. However, in the case of both prior art designs their ability to provide such a second position consistently is limited in order to avoid compromising their primary function, namely to provide chamber isolation leading to accurate metering of the dose.

An advantage of the invention described in this application over both of the above is that it ensures continuous exposure of the metering chamber walls to the formulation composition both at rest and during actuation. Both of the above designs rely on only a very narrow gap between the chamber walls and the stem at rest effectively isolating the walls from the formulation composition at rest. Continuous exposure allows rapid saturation of the surfaces with active drug hence improving drug dose consistency. Gradual saturation over several actuations, as would be expected with both of the prior art designs, would be expected to lead to inconsistent dose delivered.

In the case of WO 94/01347 an added drawback to the design is related to the transfer port and its passage through the inner sealing gasket. During this operation the edges of the port (hole) can act as a knife abrading the elastomeric seal as the port is repeatedly reciprocated through the seal during actuation. This can lead to particulate generation which can be ultimately inhaled by the patient. Additionally damage can occur to the inner sealing surface of the seal which can lead to impaired function.

Furthermore both of the prior art designs incorporate a chamber isolating seal whose inside diameter is generally the same size as the bore of the metering chamber by virtue of the moving member (stem or piston) passing through the seal. This in turn determines the volume of elastomer employed in the seals construction.

A further requirement of such metering valves is that extractables from the valve components, in particular the elastomeric seals are desired to be a minimum in order to in turn minimise leachables entering the pharmaceutical composition from said seals which are in turn inhaled by the patient.

The following invention seeks to provide a new arrangement of valve assembly for pressurised metered dose aerosol containers which improves the pressure filling ability of the valve, gives rapid chamber surface saturation with components of the pharmaceutical composition, and reduces particulate generation and extractables generation.

The invention comprises a metering valve for dispensing a pressurised formulation from a container and comprising a valve stem extending within and slidable relative to a cup shaped valve body, the valve stem extending through an outer seal closing off an open end of the valve body and carrying an inner seal, a clearance being provided between the outer surface of the inner seal and an inner surface of the valve body to provide a path for said formulation to enter a chamber within the valve body and a spring urging the valve stem against the outer seal in which movement of the valve stem against the spring action causes the inner seal to engage part of the valve body to define a temporary metering chamber within the body between the outer seal and the inner seal and further depression of the valve stem allows product to flow from the metering chamber to atmosphere.

Preferably the valve body is of stepped cylindrical configuration, the inner seal being within a larger diameter portion of the valve body in its rest position and slidably engaging a smaller diameter portion to form the metering chamber.

The inner seal is preferable a disc like seal surrounding and extending from the valve stem. The seal may be an annular disc of substantially rectangular cross-section.

The valve stem preferably includes an annular flange, the inner seal being located between the flange and an end of the spring. The inner seal preferably extends radially beyond the flange. An outer edge of the inner seal may be deflected to allow pressure filling of a container to which the valve is attached.

The outer seal and/or inner seal may be formed from an elastomeric material such as nitrile, polychloroprene, butyl, chloro-butyl, bromo-butyl, epdm or a thermoplastic elastomer. The valve stem and valve body may be formed of polymeric material such as polyester, nylon or POM or may alternatively be formed from stainless steel.

The invention also comprises a pressurised dispenser container comprising a valve as described above attached to a container for containing a product to be dispensed. The product is preferably a pharmaceutical formulation within the container.

A preferred embodiment of the invention will now be described, by way of example, with reference to the accompanying, non-limiting drawings in which.

Figure 1:
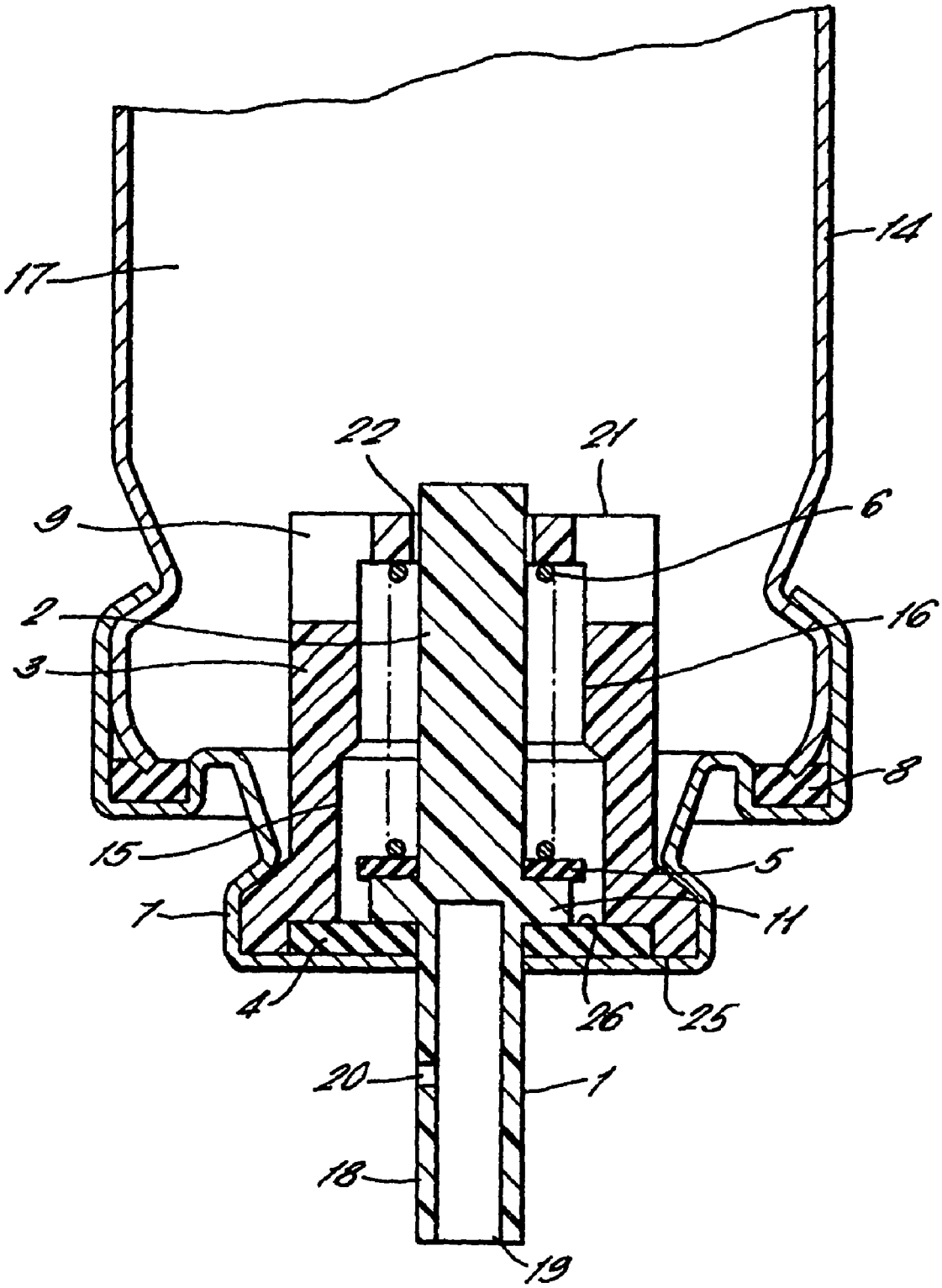
FIG. 1 is a sectional view of the valve assembly in accordance with the invention, in which the valve is shown in the closed, non-dispensing position.

A metering valve 1 held in position to seal a dispensing container 14 by a closure 7 which is crimped to an open neck of the container 14. An elastomer sealing gasket 8 trapped between the open neck of the container 14 and a part of closure 7 prevents leakage of a product 17 within the container and the container 14. The product within the container 14 is generally a pharmaceutical formulation.

The main components of the metering valve 1 are a valve stem 2, a valve body 3, an outer seal 4, an inner seal 5 and a spring 6 urging the valve stem into the position shown in FIG. 1.

The valve stem 2 is of generally elongate cylindrical shape having a radially extending flange 11 in a middle portion of the valve stem and including a hollow tubular portion 18 which extends through the outer seal 4 and is open at its outer end 19. The tubular portion includes a side hole 20.

The valve body 3 is a cup shaped body of stepped cylindrical configuration having a larger diameter portion 15 and a smaller diameter portion 16. A closed end 21 of the valve body which is adjacent to the smaller diameter portion 16 has a central aperture 22 through which an end of the valve stem 2 slides, and includes apertures 9 to permit flow of product from within the container 17 into the interior of the valve body 3.

An open end 25 of the valve body includes a recess 26 which provides a seat for the outer seal 4 which is trapped between the seat 26 and inner surface of closure 7.

The inner seal 5 is flat disc of annular form and of substantially rectangular cross-section. The inner seal 5 held against a surface of annular flange 11 remote from outer seal 4 by the spring 6 which is located between the inner seal 5 and an inner surface of closed end 21 of the valve body 3. The inner diameter of the inner seal 5 is a close fit around the valve stem 2 and the outer diameter is such that the inner seal 5 extends beyond the outer edge of annular flange 11.

The larger diameter portion 15 of the valve body provides a clearance between its inner surface and the outer diameter of inner seal 5. The smaller diameter portion 16 of the valve body 3 is of such a size that the inner seal 5 comes into sliding sealing engagement with the smaller diameter portion 16 as the valve stem 2 is depressed within the valve body from the position shown in FIG. 1.

At rest, as shown in FIG. 1, the spring 6 urges the valve stem into the position shown in FIG. 1 so that the flange 11 is held against outer seal 4. In this position, product within the container 17 may flow into the interior of the valve body through apertures 9.

Figure 2:
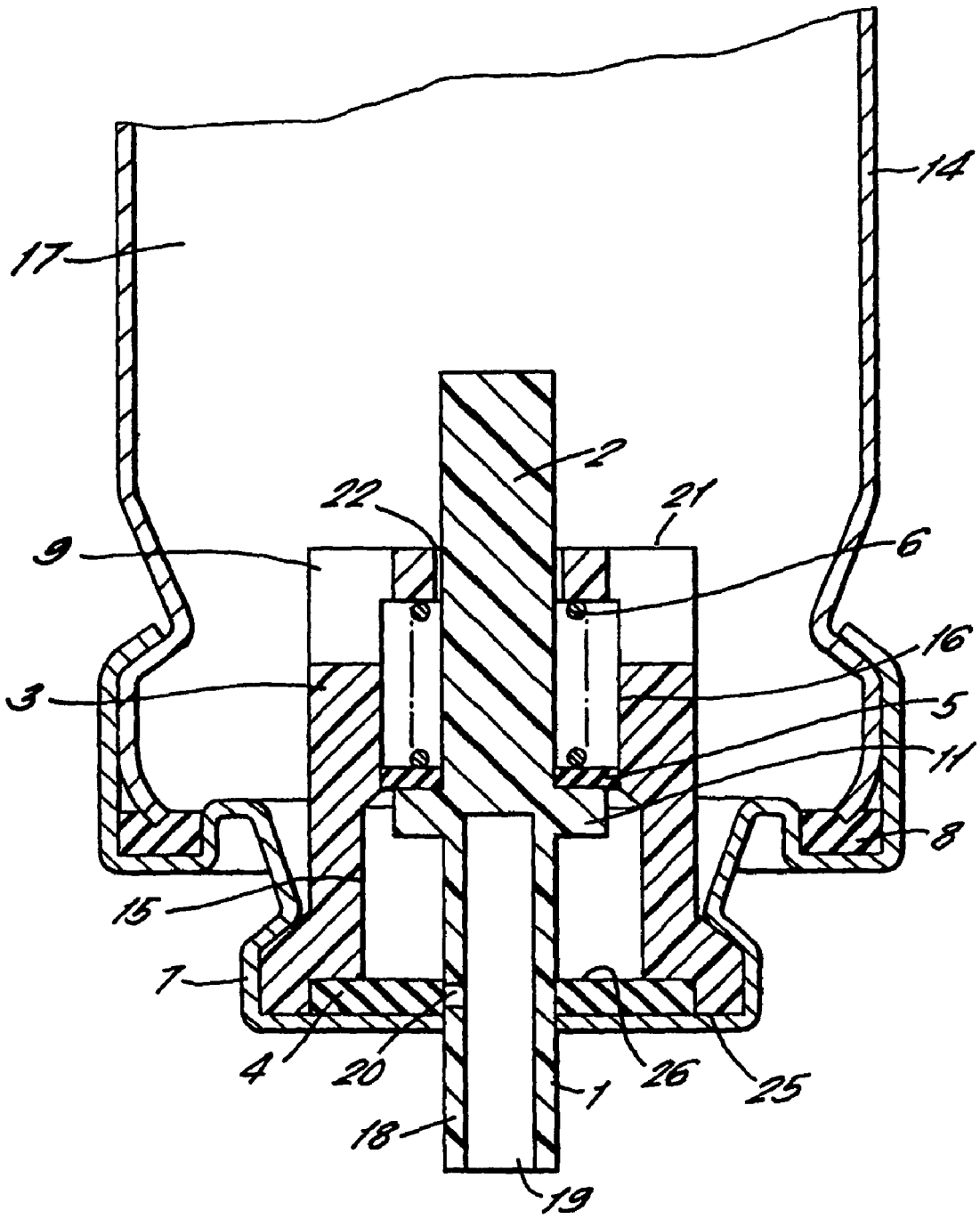
FIG. 2 is a sectional view of the valve FIG. 1 in the chamber formed position.

Movement of the valve stem 2 against the action of spring 6 causes the flange 11 and inner seal 5 to move away from the outer seal 4, at the same time allowing product from the container 17 to flow around the outer edges of inner seal 5 and fill the space between flange 11 and outer seal 4. Continued depression of the valve stem 2 causes the inner seal 5 to engage with the smaller diameter portion 16 of the valve body 3. At this position (shown in FIG. 2) a temporary metering chamber 13 is created within the valve body 3 between inner seal 5 and outer seal 4.

Figure 3:
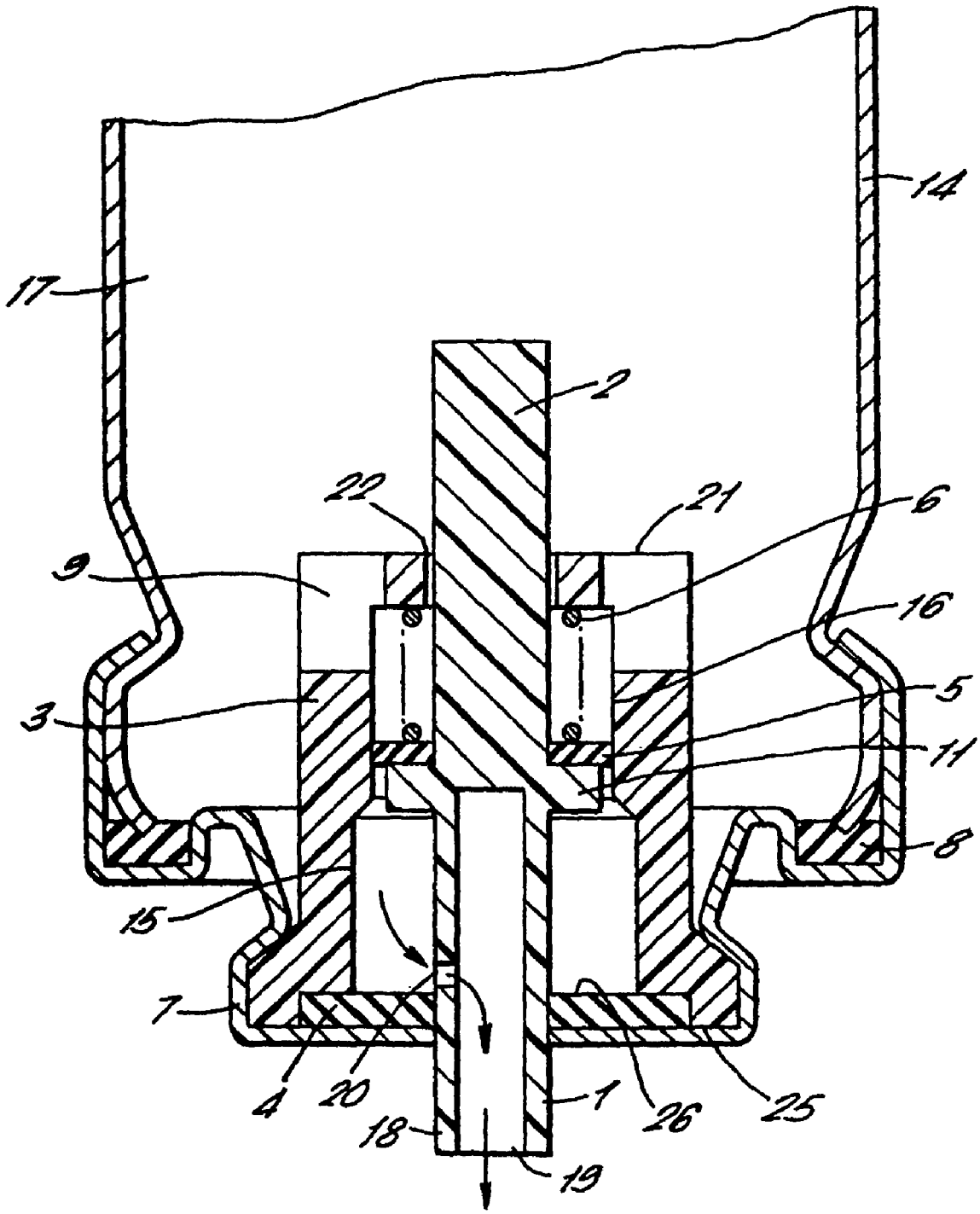
FIG. 3 is sectional view of the valve of FIG. 1 in the dispensing position.

Continued depression of the valve stem 2 to the position shown in FIG. 3 causes the side hole or port 20 to pass through the outer seal 4. This provides an exit passage for the product within the metering chamber 13 which is dispensed to atmosphere via port 20 and hollow section 18 of the valve stem 2.

The valve stem 2 is located coaxially within the valve 1 by the centre hole in the closure 7 and the centre hole 22 in the valve body 3. The hollow part of the valve stem 2 is in sliding and sealing engagement with the outer seal 4.

The valve body 3 and valve stem 2 may be made of any suitable material but are preferably made of a polymeric material such as nylon, polyester or POM. Alternatively, the body and stem may be manufactured from stainless steel.

The inner 5 and outer 4 seals, and preferably the sealing gasket 8 are made from an elastomeric material which is preferably chosen from nitrile, butyl, polychloroprene, epdm or a thermoplastic elastomer.

Figure 4:
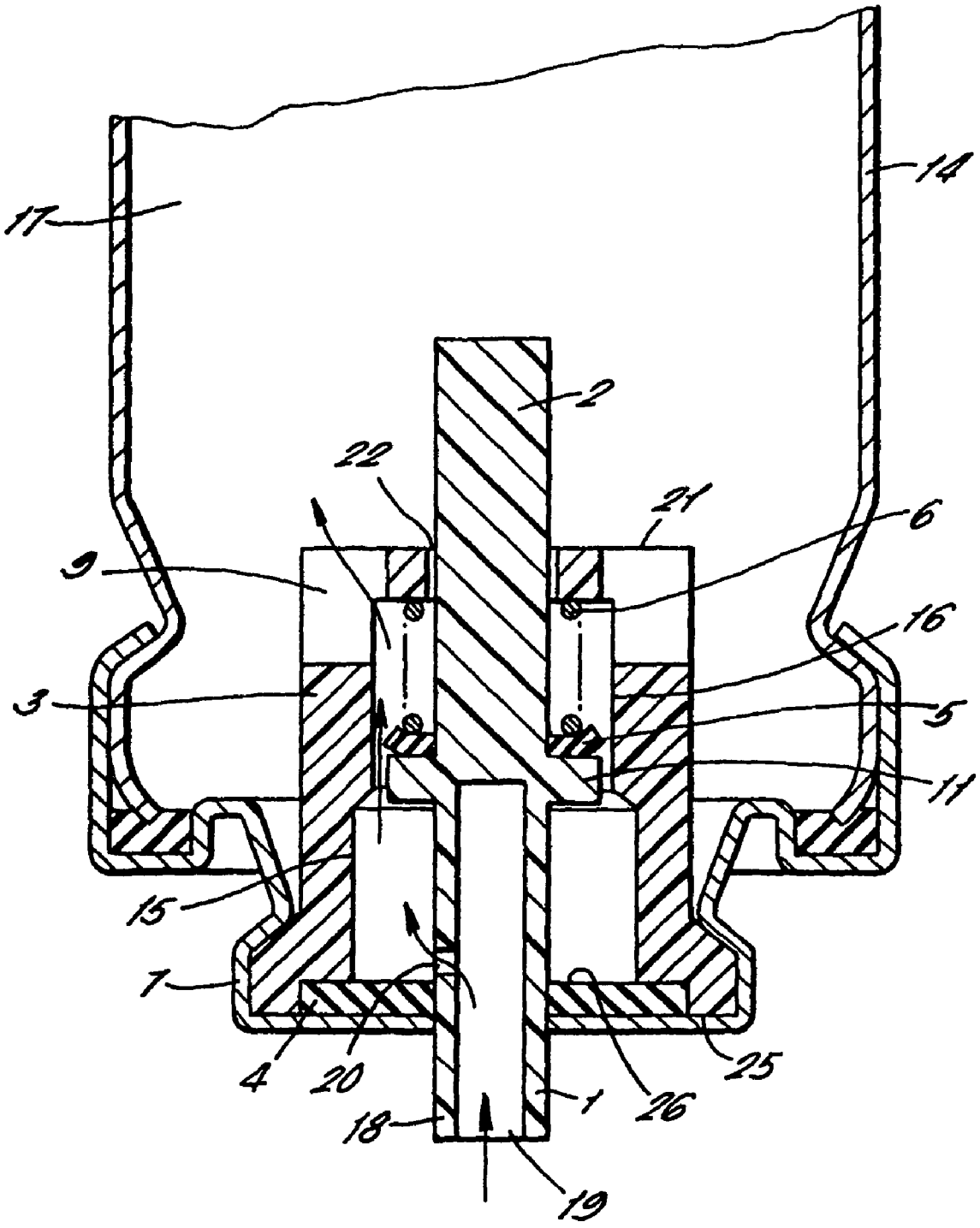
FIG. 4 is a sectional view of the valve in pressure filling position.

FIG. 4 illustrates the way in which the container 14 is pressure filled through the valve 1. At the maximum displacement of the valve stem 2 within the valve body 3, the valve is in the position shown in FIG. 4. In this position, product 17 is inserted into the container 14 by a pressure filling head shown schematically in FIG. 4. The product passes through the hollow section 18 of valve stem 2, through the port 20 and into the interior of the valve body 3. As shown in FIG. 4, the outer edge of inner seal 5 is deflected by the pressure of the product being inserted into the container 14 from the filling machine and passes around the deflected edge of inner seal 5 along a clearance between the inner surface of the smaller diameter portion 16 of the valve body and the inner seal 5 then into the container 14 via apertures 9.

The invention is not limited to the embodiment described above and modifications may be made within the scope of the invention as defined in the claims. For example, the inner seal 5 may be of cross-sections other than rectangular provided the seal is still generally disc like and extends beyond the flange 11.

The invention claimed is:

1. A metering valve for dispensing a pressurised formulation from a container and comprising a valve stem extending within and slidable relative to a cup shaped valve body, the valve stem extending through an outer seal closing off an open end of the valve body and carrying an inner seal, a clearance being provided between the outer surface of the inner seal and an inner surface of the valve body to provide a path for said formulation to enter a chamber within the valve body, and a spring urging the valve stem against the outer seal in which movement of the valve stem against the spring action causes the inner seal to engage part of the valve body to define a temporary metering chamber within the body between the outer seal and the inner seal and further depression of the valve stem allows product to flow from the metering chamber to atmosphere, the valve body being of stepped cylindrical configuration, the inner seal being within a larger diameter portion of the valve body in its rest position and slidably engaging a smaller diameter portion to form the metering chamber, the valve stem including an annular flange and the inner seal being located between the flange and an end of the spring such that the inner seal is held against the flange by the spring, and said inner seal having an outer edge that is deflectable by a pressure filling fluid to allow pressure filling of the container to which the valve is attached by allowing a flow of pressure filling fluid to pass between the deflected outer edge of the inner seal and the valve body.

2. A metering valve as claimed in claim 1 in which the inner seal is a disc like seal surrounding and extending outwardly from the valve stem.

3. A metering valve as claimed in claim 2 in which the inner seal is an annular disc of substantially rectangular cross-section.

4. A metering valve as claimed in claim 1 in which the inner seal extends radially beyond the flange.

5. A metering valve as claimed in claim 1 in which at least one of the outer seal and inner seal is formed from an elastomeric material selected from nitrile, polychloroprene, butyl, chloral-butyl, bromo-butyl, EPDM or a thermoplastic elastomer.

6. A metering valve as claimed in claim 1 in which the valve stem and valve body are formed from a polymeric material selected from polyester, nylon or POM.

7. A metering valve as claimed in claim 1 in which the valve body and valve stem are formed from stainless steel.

8. A pressurised dispensing container comprising a metering valve as claimed in claim 1, the valve being fixed to a container for containing the product to be dispensed.

9. A pressurized dispensing container as claimed in claim 8 and further comprising a pharmaceutical formulation within the container.

* * * * *